United States Patent [19]

Tsuda et al.

[11] Patent Number: 5,002,619

[45] Date of Patent: Mar. 26, 1991

[54] METHOD OF PRODUCING FE-NI SERIES ALLOYS HAVING IMPROVED EFFECT FOR RESTRAINING STREAKS DURING ETCHING

[75] Inventors: Masaomi Tsuda; Toshihiko Taniuchi, both of Kanagawa, Japan

[73] Assignee: Nippon Yakin Kogyo Co., Ltd., Kyobashi, Japan

[21] Appl. No.: 414,539

[22] Filed: Sep. 29, 1989

[30] Foreign Application Priority Data

Oct. 7, 1988 [JP] Japan ..... 63-251880
Oct. 7, 1988 [JP] Japan ..... 63-251881

[51] Int. Cl.[5] ..... C22F 1/10

[52] U.S. Cl. ..... 148/11.5 R; 148/11.5 N; 148/12 R

[58] Field of Search ..... 148/11.5 N, 11.5 R, 148/12 R, 2

[56] References Cited

FOREIGN PATENT DOCUMENTS 60-128253 7/1985 Japan .
61-223188 10/1986 Japan .

*Primary Examiner*—R. Dean
*Attorney, Agent, or Firm*—Dvorak and Traub

[57] ABSTRACT

An ingot of Fe-Ni series alloy comprising 30–80 wt % of NI or further 0.001–0.03 wt % and B and the balance of Fe is upset at a forging ratio of at least 1/1.2U, hot forged at a total sectional reduction ratio of at least 30% to form a slab, from which fine crystal grains are formed at final heat treating stage, whereby Fe-Ni series alloys for electronic and electromagnetic materials are economically produced without generating streaks at the etching.

4 Claims, No Drawings

METHOD OF PRODUCING FE-NI SERIES ALLOYS HAVING IMPROVED EFFECT FOR RESTRAINING STREAKS DURING ETCHING

BACKGROUND OF THE INVENTION

1. Field of the Invention

This invention relates to a method of producing Fe-Ni series alloys having an improved effect of restraining streaks during the etching, and more particularly to a method of producing Fe-Ni series alloys suitable as a material for use in an electronic equipment such as a shadow mask for color television cathode tube, an electron-ray indicator tube or the like.

2. Related Art Statement

Iron-nickel series alloys (hereinafter abbreviated as Fe-Ni alloy) used as a material for a shadow mask of a color television cathode tube are pointed out to have a drawback that white stringer pattern or so-called streak is caused in the production of the shadow mask through photoetching.

As a technique for restraining the occurrence of streak during the etching, there have hitherto been proposed the following methods. For example, Japanese Patent laid open No. 60-128,253 discloses a method of restraining the occurrence of streak, wherein an ingot is heated above 850° C. and forged at a total sectional reduction ratio of not less than 40% per one heat to mitigate a segregation portion of nickel.

Furthermore, Japanese Patent laid open No. 61-223,188 discloses a method of restraining the occurrence of streak, wherein the segregation ratio of nickel and the segregation zone thereof are controlled through the prevention of segregation in the production of ingots or by subjecting to a diffusion treatment of nickel through a heat treatment in the production step of bars.

However, the conventional technique disclosed in Japanese Patent laid open No. 60-128,253 is a method of conducting the forging at the total sectional reduction ratio of more than 40%, but the segregation of various elements can not substantially be restrained since such a forging is under a usually used loading. As a result, it is insufficient to prevent the occurrence of streaks during the etching.

On the other hand, the technique disclosed in Japanese Patent laid open No. 61-223,188 is a method of mitigating the component segregation through the diffusion of Ni based on high-temperature heat treatment. However, since the sheet thickness is thin as compared with the case of heating at the slab stage, the oxidation loss becomes relatively large and the yield considerably and undesirably lowers.

In the above conventional techniques, there is the following problem. That is, in shadow masks for various displays requiring a higher precision as compared with general-purpose television displays, the size of hole to be pierced is smaller by about ½ than and also the number of holes is larger by 2 or more than those in the usual case. Therefore, if it is intended to manaufacture such a high precision shadow mask, the quality of the starting material itself depends upon the uniformity of the hole during the etching. However, the conventional techniques can not completely restrain the occurrence of streaks during the etching because the improvement of the material quality is not proceeded at the present.

SUMMARY OF THE INVENTION

Under the above circumstances, it is an object of the invention to provide Fe-Ni series alloys not causing streaks during the etching.

It is another object of the invention to produce Fe-Ni series alloys in a high yield and a low cost without performing high-temperature heat treatment.

The above objects and others of the invention are easily achieved by the following features.

According to a first aspect of the invention, there is a method of producing Fe-Ni series alloys having an improved effect of restraining occurrence of streaks during etching, which comprises heating an ingot of Fe-Ni series alloy consisting of 30–80 wt% of Ni and the balance being substantially Fe at a temperature of not lower than 900° C., and then subjecting it to an upsetting at a forging ratio of not less than 1/1.5 U and further to a hot forging at a total sectional reduction ratio of not less than 50% to from a slab.

In a preferred embodiment of the first invention, an alloy consisting of 30–50 wt% of Ni and the balance being substantially Fe is used as an Fe-Ni alloy.

According to a second aspect of the invention, there is the provision of a method of producing Fe-Ni series alloys having an improved effect of restraining occurrence of streaks during etching, which comprises heating an ingot of Fe-Ni series alloy consisting of 30–80 wt% of Ni, 0.001–0.03 wt% of B and the balance being substantially Fe at a temperature of not lower than 900° C., and then subjecting it to an upsetting at a forging ratio of not less than 1/1.2U and further to a hot forging at a total sectional reduction ratio of not less than 30% to from a slab.

In a preferred embodiment of the second invention, an alloy consisting of 30–50 wt% of Ni, 0.001–0.03 wt% of B and the balance being substantially Fe is used as an Fe-Ni alloy.

The above structures of the invention and other objects thereof will be more clarified from the following description and examples.

DESCRIPTION OF THE PREFERRED EMBODIMENTS

The inventors have made studies on the occurrence of streaks in the Fe-Ni series alloys and confirmed that main causes of the streak are as follows:

1 segregation of impurity elements such as C, Si, Mn, Cr and the like; and 2 difference of crystal structure.

That is, the segregated portions of impurity elements such as C, Si, Mn, Cr and the like change the etching rate as compared with the other portions, which produces a difference in the hole shape formed during the photoetching, and therefore results in the occurence of streaks.

On the other hand, as to the difference of crystal structure, for example, portions largely orienting (100) plane are fast in the etching rate as compared with the other portions, which produces the difference in the hole shape formed during the photoetching. This is due to the presence of solidification structure during the forging or columnar structure having a particular orientation. That is, the columnar structure produced during the forging is stretched in the rolling direction without disappearance at the subsequent working and heat treatment stages to retain as it is, which finally results in the occurrence of streaks.

Under the above circumstances, according to the invention, it has been attempted to overcome the aforementioned problems by not only restraining the component segregation but also regulating the crystal structure.

As the means for overcoming the above problems, according to the invention, Fe-Ni series alloys having an improved effect of restraining the occurrence of streaks during the etching have been produced by heating an ingot of Fe-Ni series alloy consisting of 30–80 wt% of Ni and the remainder being substantially Fe at a temperature of not lower than 900° C., upsetting it at a forging ratio of not less than 1/1.5U or not more than 1/1.2U in accordance with the component composition and then subjecting to a hot forging at a total sectional reduction ratio of not less than 50% or not less than 30% in accordance with the component composition.

According to the inventors' studies, it has been confirmed that when B is used as an additive component to the Fe-Ni series alloy, it has an effect of cutting the columnar structure in the slab heating and promoting its randomization. That is, according to the invention, it has been attempted to overcome the above problems by not only restraining the component segregation through the forging but also regulating the crystal structure through synergistic effect with the addition of B.

In case of alloys added with B, the growth of columnar crystal is changed (restrained) by the addition of B, so that it is sufficient to restrict the forging ratio at the above upsetting to not less than 1/1.2U and the total sectional reduction ratio at the hot forging to not less than 30%.

The invention will be described in detail below.

In the invention, the reason why the lower limit of Ni amount as a starting material is 30 wt% is due to the fact that when the Fe-Ni series alloy is used as the aforementioned functional material, if the Ni amount is less than 30 wt%, sufficient electromagnetic properties are not developed. On the other hand, when the Ni amount exceeds 80 wt%, the quality as an electronic or electromagnetic material is degraded.

Moreover, it is preferable to use Fe-Ni series alloys containing not more than 50 wt% of Ni as a material pierced through the photoetching.

Further, B is an important element considerably developing the properties of the Fe-Ni series alloy according to the invention, which not only prevents the segregation of impurity element such as C, Si, Mn, Cr or the like into crystal grain boundary but also preferentially agglomerates into the crystal grain boundary or other defective portion to form a nucleus for recrystallization, whereby the crystal grains are finely divided to improve the equiaxed crystal ratio. However, when the B amount is less than 0.001 wt%, this action is insufficient. As the B amount increases, the remarkable effect is developed, but when it exceeds 0.03 wt%, various borides containing C, O, and N are produced in addition to intermetallic compound of $M_2B$(Ni, Cr, Fe) and consequently a risk of causing solidification cracking at high temperature becomes higher, so that the upper limit should be 0.03 wt%.

In case of the ingot, the crystal structure in section of the ingot generally results in the growth of columnar crystal from both side, but produces the following phenomenon being the occurrence of streaks.

That is, it has been confirmed that the occurrence of streaks results from the fact that the macrocrystal grains (columnar crystal) having a particular orientation during the casting is elongated in the rolling direction through the rolling without disappearance at the subsequent working and heat treating stages to retain as it is. Furthermore, according to the inventors' studies, when the length of the columnar crystal having the particular orientation by working up to final sheet gauge is short, the width and length of the columnar crystal become relatively small, and consequently the partial difference in the etching rate during the etching is not observed and the continuous streaks are not formed. While, when the length of the crystal grain (columnar crystal) is long, the width and length remain as they are even after the working, which form the streaks in the etching.

The inventors have further found that the length of crystal grain limiting the occurrence of streaks can be determined by varying the forging ratio at the upsetting. That is, when the forging ratio at the upsetting is less than 1/1.5U, the length of the crystal grain becomes too long to cause the occurrence of streak.

Moreover, the forging ratio at the upsetting is dependent upon the existence or nonexistence of boron. That is, in case of B-containing Fe-Ni series alloy, the value of the forging ratio is sufficient to be not less than 1/1.2U. Because, when the forging ratio in the B-containing Fe-Ni series alloy is less than 1/1.2U, the uniformization of crystal can not sufficiently be attained and hence the streaks are generated. This will be described in detail below.

The occurrence of streaks has been confirmed to result from the fact that macrocrystal grains (columnar crystal) produced in the forging and having a particular orientation are elongated in the rolling direction after the subsequent working and heat treating steps and remain as they are without disappearance. As to this point, according to the inventors' studies, short crystal grains among grains having a particular orientation when being worked (rolled) up to a final sheet gauge are relatively small in the crystal grain size, so that there is partially caused no difference in the etching rate at the etching, and consequently these grains are not observed as continuos streaks. On the other hand, when the length of the crystal grain (columnar crystal) is long, the width and length of this crystal grain are held even after the working, or these large crystal grains are remained to produce streaks at the etching.

The length of the crystal garin limiting the occurrence of streaks can be determined by the degree of the upsetting. When the forging ratio at the upsetting is less than 1/1.2U, the length of the crystal grain becomes longer to cause the occurrence of streaks. Thus, the limit of the crystal grain length is determined as mentioned above.

Then, the total sectional reduction ratio at the hot forging (inclusive of actual forging and extension forging) followed by the upsetting is required to be not less tha 50% in case of Fe-Ni series alloy containing no B and not less than 30% in case of B-containing Fe-Ni series alloy. Because, when the total sectional reduction ratio at the hot forging is less than 50% or 30% in accordance with the alloy used, the mitigation of component segregation through the forging can not sufficiently be achieved. Moreover, the reason why the difference is caused in the total sectional reduction ratio in accordance with the existence or nonexistence of boron is due to the crytsal fining action of boron.

As mentioned above, when the ingot of Fe-Ni series alloy is forged at the above two stages under particular conditions, the uniformization of crystal grain and the mitigation of component segregation can be attained and also the very excellent etching property can be ensured to restrain the occurrence of streaks at the etching. Therefore, according to the invention, Fe-Ni series alloys can be produced without generating streaks at the etching.

The following examples are given in illustration of the invention and are not intended as limitations thereof.

EXAMPLE 1

The following Table 1 shows production conditions such as chemical composition of Fe-Ni series alloy used in this example and evaluation of product obtained therefrom under production conditions.

As the alloys (No. 1–No. 6) particularly shown in Table 1 and aiming at the invention, molten metal melted in an electric furnace was refined by AOD process or VOD process and rendered into an ingot, which was upset under the conditions shown in Table 1 to form a slab. The slab was hot forged at a total sectional reduction ratio of 50–85% and then hot rolled to from a hot rolled sheet of 5.5 mm in thickness, which was then wound into a coil.

Then, the coil was subjected to a proper combination of cold rolling and heat treatment according to the usual manner to obtain a final product.

The thus obtained test sample was pierced through actual photoetching with a solution of ferric chloride (specific gravity:1.45, 50° C.) and the occurrence of streaks was examined. The results are shown in Table 1.

As seen from the data of Table 1, in the Fe-Ni series alloys produced according to the method of the invention, the occurrence of streaks in the etching was not substantially observed as compared with the usual Fe-Ni series alloys having the same composition and produced by the conventional method (No. 7–No. 11). It is clear that these alloys are alloys used as a stating material for etching.

TABLE 1

| | No. | Chemical composition (wt %) Fe | Ni | Heating temperature of forging (°C.) | Forging ratio (U) | Total sectional reduction ratio after forging (%) | Existence or non-existence of streak |
|---|---|---|---|---|---|---|---|
| Accept-able Example | 1 | balance | 35.8 | 1250 | 1/1.8 | 75 | non-existence |
| | 2 | | 36.1 | 1230 | 1/1.6 | 50 | |
| | 3 | | 36.1 | 1180 | 1/1.7 | 65 | |
| | 4 | | 42.0 | 1230 | 1/1.6 | 85 | |
| | 5 | | 41.7 | 1230 | 1/1.6 | 70 | |
| | 6 | | 50.2 | 1250 | 1/1.6 | 70 | |
| Compara-tive Example | 7 | balance | 36.1 | 1230 | 1/1.4 | 70 | existence |
| | 8 | | 36.0 | 1180 | — | 75 | |
| | 9 | | 42.0 | 1230 | 1/1.6 | 25 | |
| | 10 | | 50.2 | 1250 | 1/1.2 | 25 | |
| | 11 | | 35.8 | 850 | 1/1.7 | 70 | |

EXAMPLE 2

The following Table 2 shows production conditions such as chemical composition of B-containing Fe-Ni series alloy used in this example and the evaluation of product produced therefrom under production conditions.

As the alloys particularly shown in Table 2 and aiming at the invention (No. 12–No. 17), molten metal melted in an electric furnace was refined by AOD process or VOD process and rendered into an ingot. Then, the ingot was upset under the conditions shown in Table 2, hot forged at a total sectional reduction ratio of 30–70% and hot rolled to form a hot rolled sheet of 5.5 mm in thickness, which was wound into a coil.

Then, the coil was subjected to a proper combination of cold rolling and heat treatment according to the usual manner to obtain a final product.

The thus obtained test sample was pierced through actual photoetching with a solution of ferric chloride (specific gravity:1.45, 50° C.) and the occurrence of streaks was examined. The results are shown in Table 2.

As seen from the data of Table 2, in the Fe-Ni series alloys produced according to the method of the invention, the occurrence of streaks in the etching was not substantially observed as compared with the usual Fe-Ni series alloys having the same composition and produced by the conventional method (No. 18–No. 22). It is clear that these alloys are alloys used as a stating material for etching.

TABLE 2

| | No. | Chemical composition (wt %) Fe | Ni | B | Heating temperature of forging (°C.) | Forging ratio (U) | Total sectional reduction ratio after forging (%) | Existence or non-existence |
|---|---|---|---|---|---|---|---|---|
| Accept-able Example | 12 | balance | 35.9 | 0.010 | 1180 | 1/1.4 | 35 | non-existence |
| | 13 | | 36.2 | 0.009 | 1230 | 1/1.5 | 40 | |
| | 14 | | 36.2 | 0.011 | 1230 | 1/1.8 | 40 | |
| | 15 | | 42.1 | 0.007 | 1250 | 1/1.3 | 65 | |
| | 16 | | 42.2 | 0.011 | 1250 | 1/1.3 | 70 | |
| | 17 | | 50.2 | 0.009 | 1230 | 1/1.5 | 40 | |
| Compara-tive Example | 18 | balance | 35.9 | 0.010 | 1230 | 1/1.3 | 25 | existence |
| | 19 | | 36.1 | — | 1250 | 1/1.3 | 70 | |
| | 20 | | 50.2 | 0.009 | 1180 | 1/1.1 | 40 | |
| | 21 | | 35.9 | 0.010 | 1250 | — | 70 | |
| | 22 | | 36.2 | 0.011 | 850 | 1/1.5 | 65 | |

As mentioned above, the Fe-Ni series alloys produced according to the method of the invention have no streak after the photoetching, so that the invention can economically provide Fe-Ni series alloys having properties desired as electronic or electricmagnetic material.

Moreover, the Fe-Ni series alloys according to the invention are applied as a an ingot of Fe-Ni series alloy such as 36Ni invar alloy for shadow mask, 42Ni alloy for lead frame, Fe-Ni series alloy for electron and electromagnetic use aiming at low thermal expansion properties and magnetic properties, permalloy used as as electromagentic material and the like.

What is claimed is:

1. A method of producing Fe-Ni series alloys having an improved effect of restraining occurrence of streaks during etching, which comprises heating an ingot of Fe-Ni series alloy consisting of 30–80 wt% of Ni and the balance being substantially Fe at a temperature of not lower than 900° C., and then subjecting it to an upsetting at a forging ratio of not less than 1/1.5U and further to a hot forging at a total sectional reduction ratio of not less than 50% to a slab.

2. The method according to claim 1, wherein said Fe-Ni alloy consists of 30–50 wt% of Ni and the balance being substantially Fe.

3. A method of producing Fe-Ni series alloys having an improved effect of restraining occurrence of streaks during etching, which comprises heating an ingot of Fe-Ni series alloy consisting of 30–80 wt% of Ni, 0.001–0.03 wt% of B and the balance being substantially Fe at a temperature of not lower than 900° C., and then subjecting it to an upsetting at a forging ratio of not less than 1/1.2U and further to a hot forging at a total sectional reduction ratio of not less than 30% to a slab.

4. The method according to claim 3, wherein said Fe-Ni alloy consists of 30–50 wt% of Ni, 0.001–0.03 wt% of B and the balance being substantially Fe.

* * * * *